US006183296B1

(12) United States Patent
Pacini et al.

(10) Patent No.: US 6,183,296 B1
(45) **Date of Patent: *Feb. 6, 2001**

(54) ELECTRICAL CONNECTOR

(75) Inventors: Louis S. Pacini, Niles; Arun J. Shah, Bartlett, both of IL (US)

(73) Assignee: Cinch Connectors, Inc., Lombard, IL (US)

( * ) Notice: Under 35 U.S.C. 154(b), the term of this patent shall be extended for 0 days.

This patent is subject to a terminal disclaimer.

(21) Appl. No.: 09/388,406

(22) Filed: Sep. 1, 1999

Related U.S. Application Data

(62) Division of application No. 09/132,093, filed on Aug. 10, 1998, now Pat. No. 5,964,619, which is a division of application No. 08/606,228, filed on Feb. 23, 1996, now Pat. No. 5,871,373.

(51) Int. Cl.[7] ..... H01R 33/945
(52) U.S. Cl. ..... 439/577
(58) Field of Search ..... 439/595, 577, 439/274, 235, 680, 902, 589, 598, 894

(56) References Cited

U.S. PATENT DOCUMENTS

| | | | |
|---|---|---|---|
| 3,818,420 | 6/1974 | Barr | 439/680 |
| 3,874,765 | 4/1975 | Gilmore et al. | 439/464 |
| 4,627,759 | 12/1986 | Kato et al. | 439/680 |

(List continued on next page.)

FOREIGN PATENT DOCUMENTS

| | | | |
|---|---|---|---|
| 4427189 | 3/1995 | (DE) | H01R/13/436 |
| 0345988 | 12/1989 | (EP) | H01R/13/514 |
| 0529463 | 3/1993 | (EP) | H01R/13/52 |
| 0575072 | 12/1993 | (EP) | H01R/13/74 |

OTHER PUBLICATIONS

Ten (10) photographs of an electrical connector by Packard Electric which was made available to applicants in approximately Mar. 1995.

Eight (8) photographs of a storage cover for an electrical connector by Packard Electric which was made available to applicants in approximately 1994.

*Primary Examiner*—T. C. Patel
(74) *Attorney, Agent, or Firm*—Leydig, Voit & Mayer, Ltd.

(57) ABSTRACT

The electrical connector may include a housing, a contact, a secondary lock, a grommet, a backplate, a bolt, a contact removal tool, and a splash guard. The housing includes openings which receive the contacts. The grommets are positioned in cavities at the rear of the housing. The housing and backplate are designed so that the grommets are subjected to compressive forces in order to enhance the sealing characteristic of the grommets. As the contact is inserted, a locking tab engages an opening in the contact and prevents the contact from being removed from the housing. The secondary locks will increase the retention of the contact in the electrical connector. In addition, the secondary lock may include a feature which permits the partial insertion and retention of the secondary lock prior to insertion of the contact. The secondary lock also assures that the contacts have been properly inserted. The electrical connector may also include a splash guard which would assist in deflecting water from the rear of the electrical connector. The electrical connector may also include a removal tool which may be used to remove contacts from the electrical connector. The removal tool can be stored in the backplate or the housing.

26 Claims, 10 Drawing Sheets

U.S. PATENT DOCUMENTS

| | | | |
|---|---|---|---|
| 4,679,874 | 7/1987 | Saijo et al. | 439/595 |
| 4,684,190 | 8/1987 | Clark et al. | 439/587 |
| 4,705,337 | 11/1987 | Maeda | 439/595 |
| 4,711,508 | 12/1987 | Sueyoshi | 439/595 |
| 4,711,509 | 12/1987 | Cross et al. | 439/587 |
| 4,750,893 | 6/1988 | Sueyoshi et al. | 439/596 |
| 4,767,361 | 8/1988 | Hoshino et al. | 439/596 |
| 4,806,123 | 2/1989 | Konishi et al. | 439/595 |
| 4,810,208 | 3/1989 | Hayes et al. | 439/589 |
| 4,944,688 | 7/1990 | Lundergan | 439/275 |
| 4,944,695 | 7/1990 | Tsuji et al. | 439/595 |
| 4,946,398 | 8/1990 | Takenouchi et al. | 439/599 |
| 4,946,402 | 8/1990 | Fink et al. | 439/274 |
| 4,950,182 | 8/1990 | Zielinski et al. | 439/595 |
| 4,963,106 | 10/1990 | Wendling et al. | 439/595 |
| 4,973,268 | 11/1990 | Smith et al. | 439/595 |
| 4,975,082 | 12/1990 | Nagasaka et al. | 439/595 |
| 4,998,896 | 3/1991 | Lundergan | 439/595 |
| 5,002,504 | 3/1991 | Carlson | 439/599 |
| 5,071,369 | 12/1991 | Denlinger et al. | 439/595 |
| 5,071,374 | 12/1991 | Plocek et al. | 439/752 |
| 5,085,599 | 2/1992 | Maejima et al. | 439/595 |
| 5,100,346 | 3/1992 | McCardell | 439/595 |
| 5,151,045 | 9/1992 | Cravens et al. | 439/271 |
| 5,151,052 | 9/1992 | McCardell | 439/598 |
| 5,167,534 | 12/1992 | Ohsumi | 439/595 |
| 5,199,902 | 4/1993 | Kahle et al. | 439/595 |
| 5,211,583 | 5/1993 | Endo et al. | 439/595 |
| 5,266,047 | 11/1993 | Black et al. | 439/364 |
| 5,271,739 | 12/1993 | Denlinger et al. | 439/466 |
| 5,292,261 | 3/1994 | Hirano et al. | 439/752 |
| 5,328,382 | 7/1994 | Pawlicki | 439/273 |
| 5,356,305 | 10/1994 | Riddle | 439/364 |
| 5,366,387 | 11/1994 | Yamanashi | 439/468 |
| 5,393,242 | 2/1995 | VanDerStuyf | 439/364 |
| 5,443,592 | 8/1995 | Ittah et al. | 439/851 |
| 5,569,051 | 10/1996 | Endo et al. | 439/752.5 |
| 5,575,684 * | 11/1996 | Uchida et al. | 439/595 |

* cited by examiner

ELECTRICAL CONNECTOR

CROSS-REFERENCE TO RELATED APPLICATION

This application is a divisional of copending U.S. patent application Ser. No. 09/132,093 filed Aug. 10, 1998 which issued as U.S. Pat. No. 5,964,619 which is a divisional of U.S. patent application Ser. No. 08/606,228 filed Feb. 23, 1996 which issued as U.S. Pat. No. 5,871,373.

FIELD OF THE INVENTION

The invention relates to an electrical connector and more particularly to an electrical connector which can be used in exterior environmental conditions.

BACKGROUND OF THE INVENTION

Electrical connectors are used in exterior environments to connect wires with various devices. The exterior environments may include agricultural equipment, construction equipment or other vehicles which may be exposed to the weather, such as, moisture and temperature extremes. In addition, such electrical connectors are subjected to vibration from the engine or the movement of the vehicle. Thus, the electrical connector should withstand these operating conditions.

In addition, it is necessary to attach the electrical connector to the individual wires. Specifically, the individual wire is attached to an electrical contact. The electrical contact with the attached wire is then assembled into the housing for the electrical connector. This process may be performed by an individual and therefore, can be relatively expensive.

OBJECTS OF THE INVENTION

A general object of the present invention is to provide an electrical connector which can withstand environmental conditions for the particular application. Another object of the invention is to provide an electrical connector which reduces the manufacturing and assembly costs. An additional object of the invention is to provide an electrical connector which minimizes the number of components for the electrical connector.

Another object of the invention is to provide alignment features for each of the components so that the components can be assembled in only one specific orientation. A further object of the invention is to provide higher contact retention so that the contact cannot be unintentionally removed from the electrical connector. Another object of the invention is to provide a secondary lock which confirms that the contact is properly positioned and also improves the retention of the contact in the electrical connector. Another object of the invention is to provide a secondary lock with a first position which retains the secondary lock in a partially inserted position and a second position which locks the contact into the insulator after the contact has been inserted.

A further object of the invention is to reduce the amount of insulator material used in the electrical connector. An additional object of the invention is to provide a contact removal tool which is included in the electrical connector and can be used by a repair person in a remote location.

Also, an object of the invention is to provide a backplate which prevents the grommet from being disassembled when a wire and contact are removed from the electrical connector. An additional object is to provide a backplate which assists the grommet in maintaining an environmentally resistant seal. Another object of the invention is to provide a backplate which orients the contact for proper insertion.

An additional object is to provide an electrical connector with "push to seat" contacts versus "pull to seat" contacts. A further object is to provide an electrical connector which includes a water shield. A further object is to provide an electrical connector which is available in different sizes depending upon the number of contacts which are required.

Other objects and advantages of the invention will become apparent upon reading the following description and upon reference to the drawings.

SUMMARY OF THE INVENTION

The electrical connector may include a housing, a contact, a secondary lock, a grommet, a backplate, a bolt, a contact removal tool, and a splash guard. The housing includes openings which receive the contacts. The contact is crimped onto the wire to create the contact and wire assembly.

The grommets are positioned in cavities at the rear of the housing. The grommets form a relatively weather resistant seal. The electrical connector may also include the backplate. The housing and backplate are designed so that the grommets are subjected to compressive forces in order to enhance the sealing characteristic of the grommets.

As the contact is inserted, a locking tab is deflected upward when the contact engages the ramp. The ramp engages an opening in the contact and prevents the contact from being removed from the housing.

Although the locking tab will prevent the contact from being removed, the secondary locks will increase the retention of the contact in the electrical connector. In addition, the secondary lock may include a feature which permits the partial insertion of the secondary lock prior to insertion of the contact and wire assembly. The secondary lock also assures that the contacts have been properly inserted.

The electrical connector may also include a splash guard which would assist in deflecting water from the rear of the electrical connector. The electrical connector may also include a removal tool which may be used to remove contacts from the electrical connector. The removal tool can be stored in the backplate.

DESCRIPTION OF THE EMBODIMENT

Figure 1:
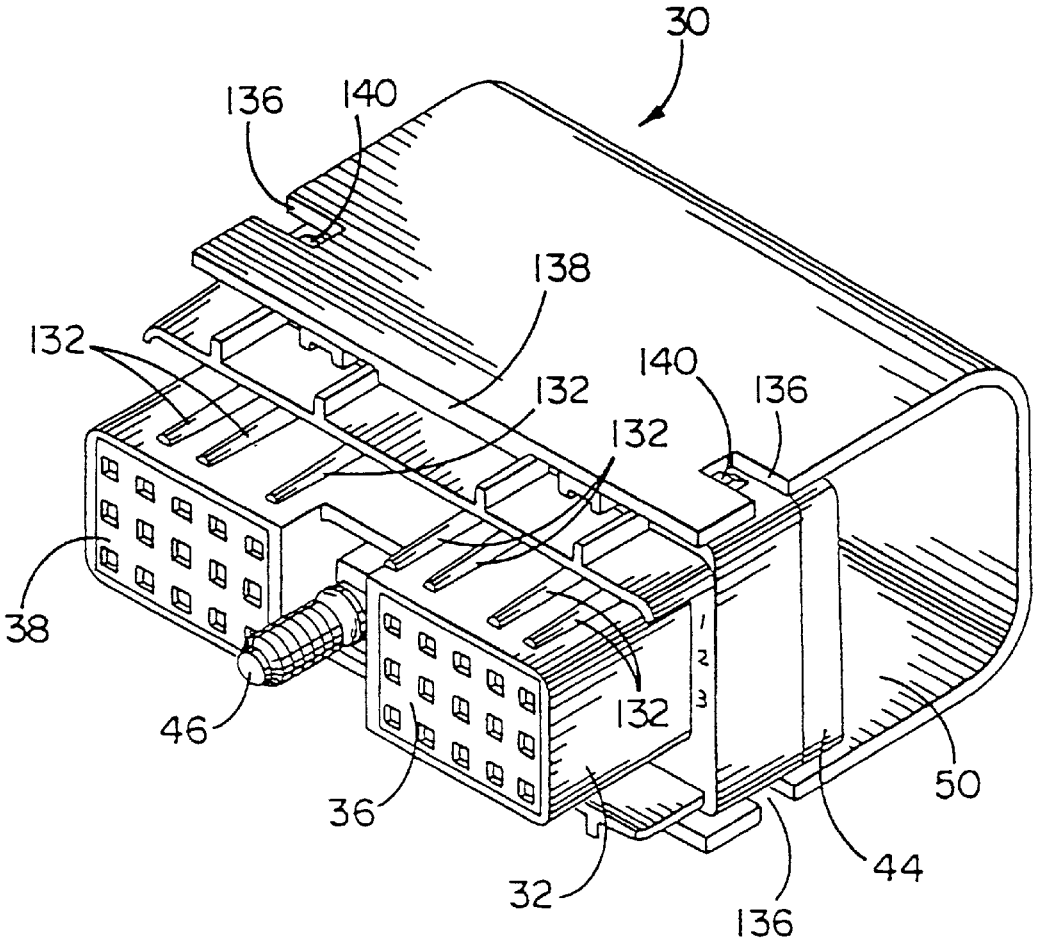
FIG. 1 is a left front perspective view of an electrical connector constructed in accordance with the teachings of the invention.
Figure 2:
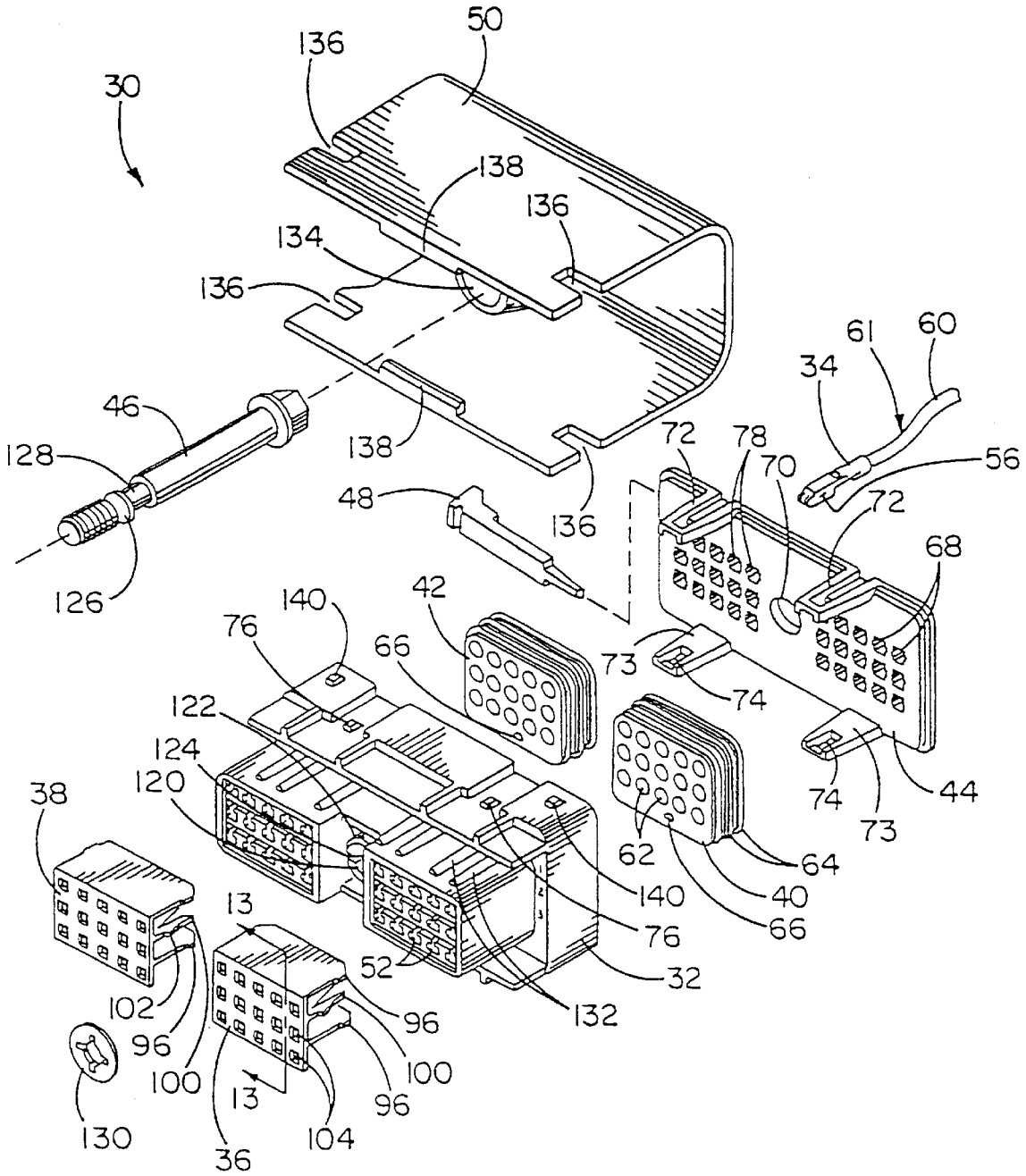
FIG. 2 is an exploded view of the electrical connector.

An electrical connector 30 constructed in accordance with the teachings of the invention is illustrated in FIG. 1. As shown in FIG. 2, the electrical connector 30 may include an insulator housing 32, a contact 34, a secondary lock 36, 38, grommets 40, 42, backplate 44, bolt 46, contact removal tool 48, and splash guard 50.

Figure 4A:
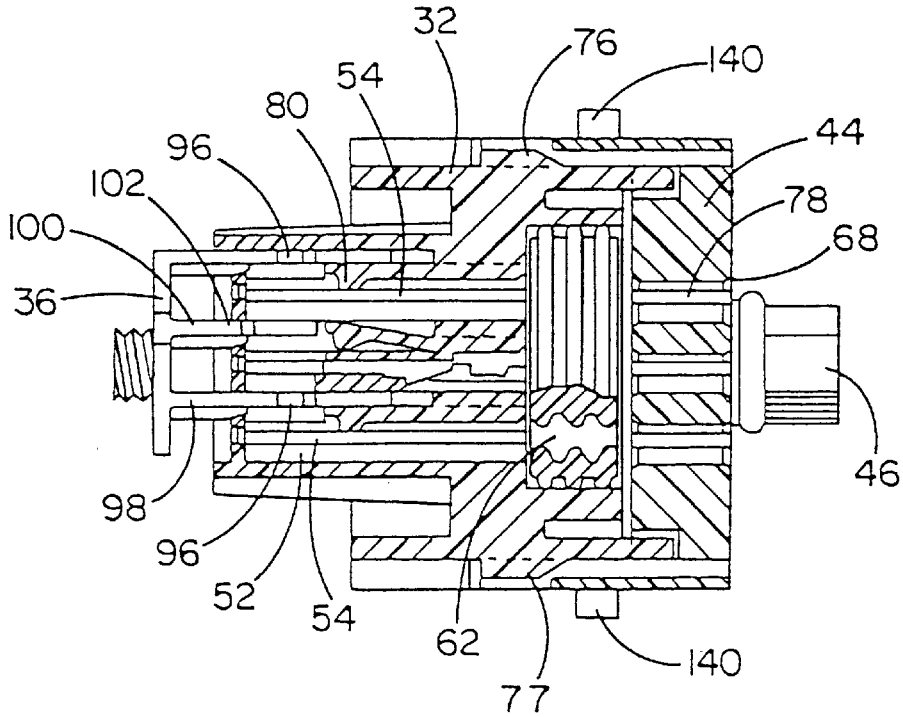
FIG. 4A is a cross-sectional view similar to FIG. 4 except the secondary lock is in the preload position and without the contacts and hood.
Figure 6:
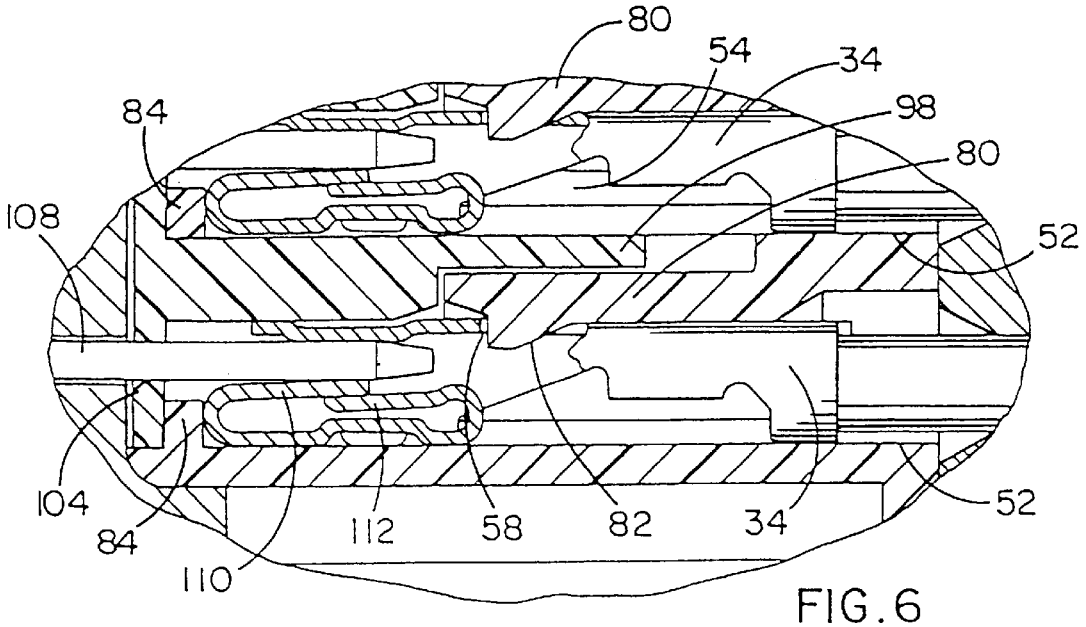
FIG. 6 is an enlarged cross sectional view of the area shown in FIG. 5.

The insulator housing 32 includes openings 52 which receive the contacts 34. The openings 52 include grooves 54 which are shown in FIGS. 4A and 6. As will be discussed below, the grooves 54 will engage protrusions 56 on the contacts 34 to align and support the contacts 34.

Figure 8:
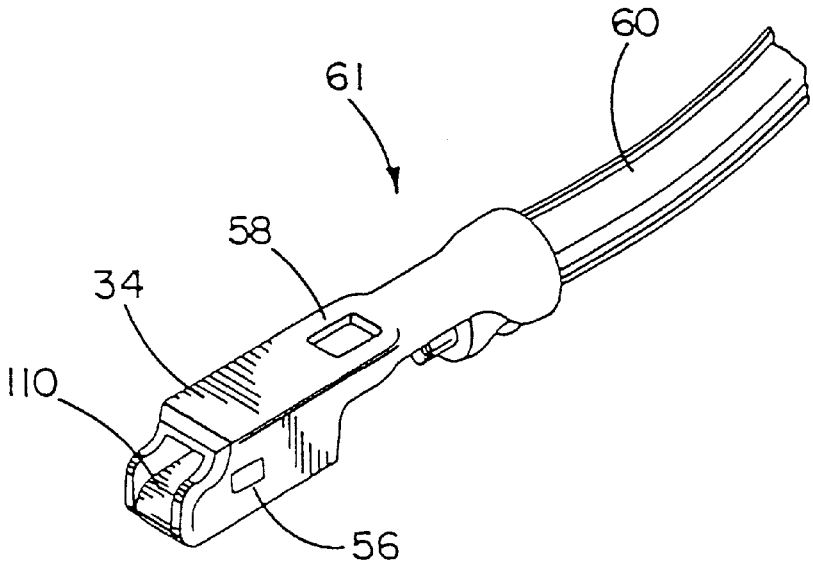
FIG. 8 is a left front perspective view of the electrical contact and an attached electrical wire.

Referring to FIG. 8, the contact 34 includes protrusions 56 and opening 58. The contact 34 is crimped onto the wire 60 to create the contact and wire assembly 61. The contact 34 is attached to the wire 60 either manually or by use of an automatic wire stripping and contact crimping machine. In order to facilitate use of the machine, the contacts 34 are available in a strip and positioned in side-by-side relationship.

The grommets 40, 42 are positioned in cavities at the rear of the housing 32. The grommets 40, 42 include apertures 62 which correspond with the openings 52 in the housing. The apertures 62 are chamfered on each side of the grommet. The grommets 40, 42 may also include ribs 64 which will engage the housing 32 to form a relatively weather resistant seal. The grommets 40, 42 include a recess 66 which engages a mating post 67 (FIGS. 4–5) on the housing 32. The recess 66 and post 67 assure the proper orientation of the grommet with the housing.

Figure 9:
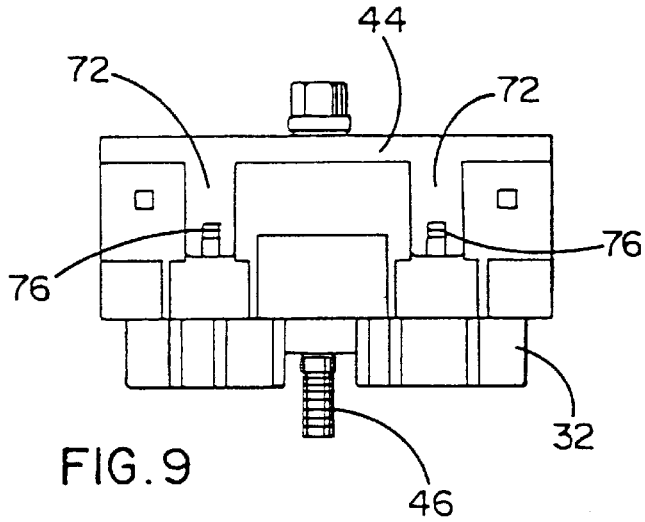
FIG. 9 is a top plan view of the electrical connector without the optional splash guard.
Figure 10:
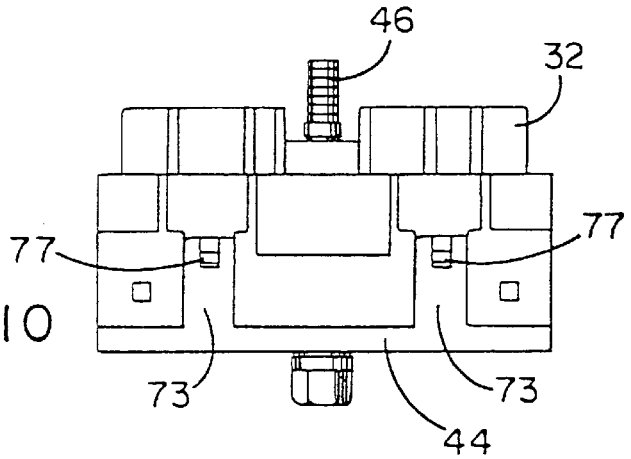
FIG. 10 is a bottom plan view of the electrical connector without the optional splash guard.
Figure 11:
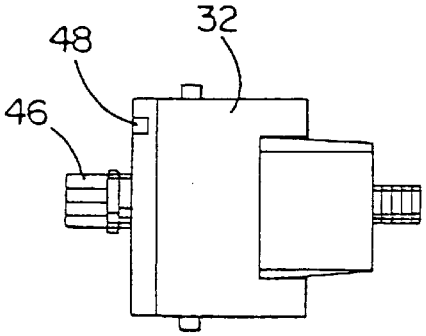
FIG. 11 is a right side view of the electrical connector without the optional splash guard.
Figure 11A:
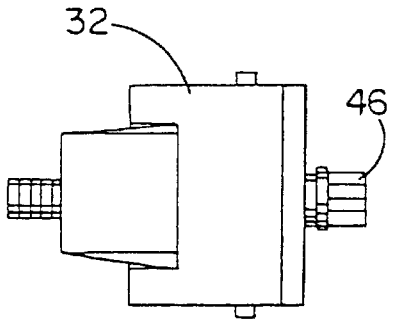
FIG. 11A is a left side view of the electrical connector without the optional splash guard.

The electrical connector may also include the backplate 44. The backplate 44 includes openings 68 which correspond with the array or configuration of the aperture 62 and openings 52. The backplate 44 also includes aperture 70 to receive bolt 46. The flanges 72, 73 and openings 74 are used to attach the backplate to the housing. Referring to FIGS. 2, 4A and 9, the housing includes protrusions 76, 77 which engage the flanges 72, 73 and openings 74 to hold the backplate in position. The housing 32 and backplate 44 are designed so that the grommets 40, 42 are subjected to compressive forces in order to enhance the sealing characteristics of the grommets.

The spacing between the upper protrusions 76 is slightly less than the spacing between the lower protrusions 77. Similarly, the spacing between the upper flanges 72 is slightly less than the spacing between the lower flanges 73. The spacing of the lower flanges 73 corresponds to the spacing of the lower protrusions 77 and the spacing of the upper flanges 72 corresponds to the spacing of the upper protrusions 76. Consequently, the backplate 44 can be assembled to the housing 32 in only one specific orientation.

Figure 12:
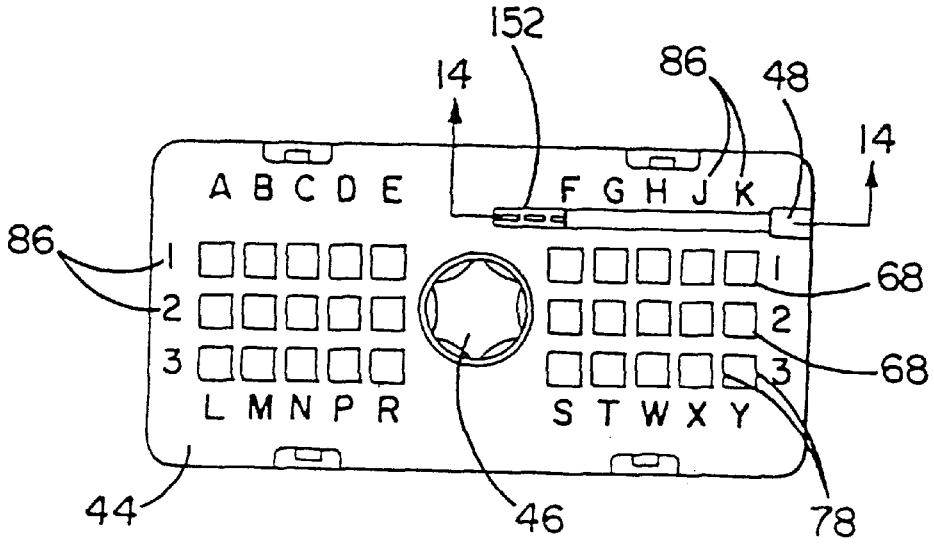
FIG. 12 is a rear view of the electrical connector without the optional splash guard.

After the grommets 40, 42 and backplate 44 have been assembled to the housing 32, the contact and wire assemblies 61 can be inserted into the appropriate opening 68 in the backplate. As shown in FIGS. 2, 4A and 12, the opening 68 includes grooves 78 similar to grooves 54 in the housing. The protrusions 56 on the contact engage the grooves 78 to maintain the proper alignment of the contact 34. The grooves 78 are configured so that the contact 34 can be inserted in only one specific orientation. The contact 34 is then pushed through the corresponding aperture 62 in the grommet.

Figure 5:
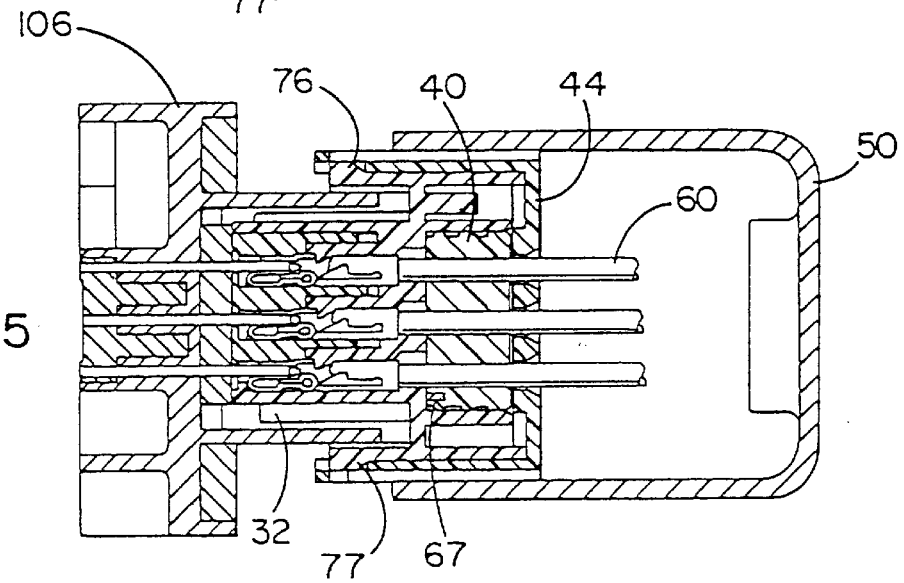
FIG. 5 is a cross sectional view of the electrical connector shown in FIG. 4 which is mated to a device or another electrical connector.

Referring to FIGS. 5 and 6, the contact is then inserted into the corresponding opening 52 in the housing. As noted above, the openings 52 include grooves 54 on two opposite sides of the rectangular openings 52. The protrusions 56 on the contact engage the grooves 54 to assure proper alignment of the contact and to support the contact in the housing. The grooves 54 are configured so that the contact 34 can only be inserted in one specific orientation.

As the contact 34 is inserted to the left in FIGS. 4A and 6, the locking tab 80 is deflected upward when the contact engages the ramp 82. As the contact moves to the left in FIG. 6, the ramp 82 engages the opening 58 in the contact 34. The opening 58 and the locking tab 80 which includes ramp 82 prevents the contact from being removed from the housing by limiting the movement of the contact to the right in FIG. 6. In addition, the housing includes a stop 84 which limits the movement of the contact 34 to the left as shown in FIG. 6. The process is then repeated for each contact and wire assembly 61.

Figure 3:
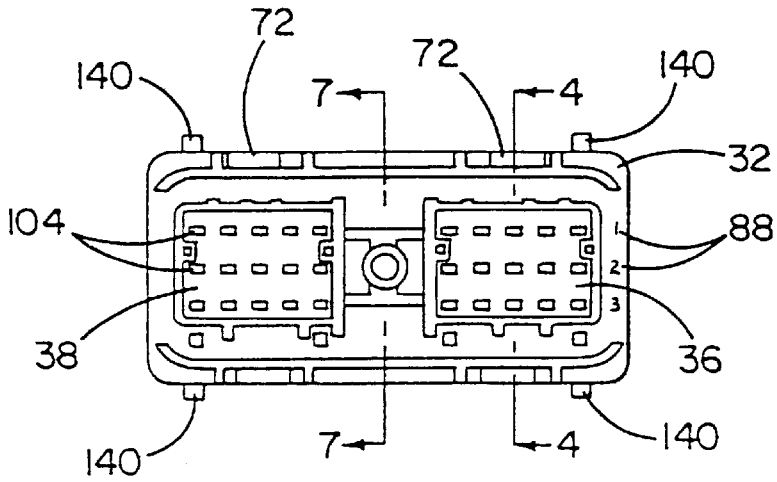
FIG. 3 is a front view of the electrical connector without the optional splash guard.

As shown in FIG. 12, the backplate 44 includes indicia 86 to identify the columns and rows. The indicia may include letters and numbers. This indicia may assist in the proper placement of contacts during assembly or during repair. As shown in FIG. 3, corresponding indicia 88 may be located on housing 32 to facilitate assembly or repair.

Although the locking tab 80 will prevent the contact from being removed, certain uses of the electrical connector may require the use of secondary locks 36, 38. The secondary locks will increase the retention of the contact in the electrical connector. In addition, the secondary lock may include a feature which permits the partial insertion of the secondary lock prior to insertion of the contact and wire assembly. This preload feature permits partial assembly prior to shipment and permits successive assembly operations.

As shown in FIG. 4A, the secondary lock 36 is partially inserted into the housing. The secondary lock includes protrusions 96 and the housing 32 includes detents which will engage the protrusions 96. The detents and the protrusions hold the secondary lock in the preload position which is shown in FIG. 4A. The secondary lock will remain in this position until a sufficient force is applied to the left or right in FIG. 4A to remove or fully insert the secondary lock.

Figure 4:
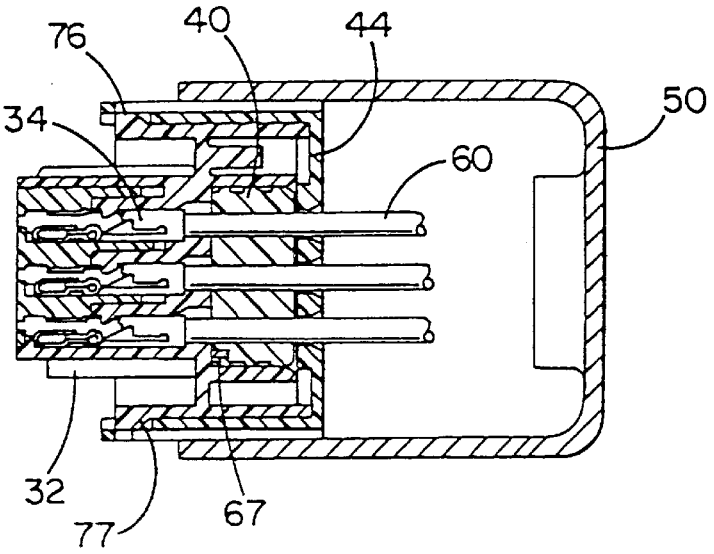
FIG. 4 is a cross sectional view of the electrical connector taken along line 4—4 of FIG. 3.
Figure 13:
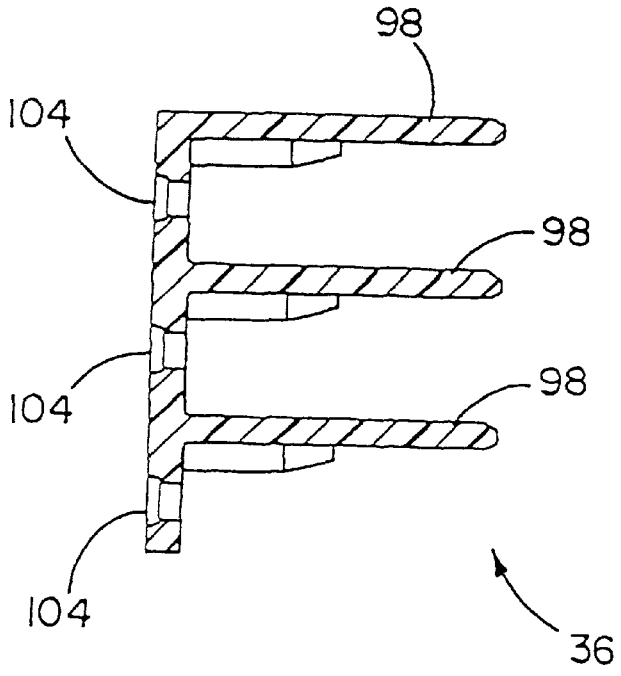
FIG. 13 is a cross sectional view of the secondary lock taken along line 13—13 of FIG. 2.

After the contact and wire assemblies 61 have been fully inserted into the appropriate positions in the housing, the secondary locks 36, 38 can be fully inserted as shown in FIGS. 4 and 6. Referring to FIGS. 6 and 13, the secondary lock includes three shelves 98. Referring to FIG. 6, the shelves 98 are adjacent to the locking tabs 80 when the secondary lock is fully inserted. The shelves 98 prevent the locking tabs 80 from deflecting upward and releasing contact 34. Thus, the secondary lock provides additional retention of the contact 34 in the electrical connector.

The secondary lock 36, 38 also assures that the contacts 34 have been properly inserted. If a contact has not been fully inserted, then the locking tab 80 will be deflected upward which will prevent the full insertion of the secondary lock. Therefore, if the secondary lock cannot be fully inserted, the contacts can be checked to determine proper insertion.

The secondary locks also have a feature to lock the secondary locks into the housing. Referring to FIG. 2, the secondary locks 36, 38 includes locking tabs 100 with protrusions 102. The locking tabs 100 engage detents in the housing 32. The locking tabs 100 and detents hold the secondary lock in the fully inserted position as shown in FIGS. 4 and 6.

Referring to FIGS. 2 and 3, the secondary locks 36, 38 also include apertures 104 which correspond with the apertures and openings in the housing, grommets and backplate. Finally, referring to FIG. 6, the shelves 98 also provide additional insulation between the rows of contacts to prevent contacts from touching each other.

Referring to FIG. 4A, it can now be appreciated that the secondary locks 36, 38 when in the preload position will not interfere with the insertion of the contacts 34. Specifically, as the contact 34 is inserted into the aperture 52 the locking tab 80 will be able to deflect without interference from the shelves 98. However, depending upon the desired assembly process, the secondary locks would not be inserted into the housing 32 until the contact and wire assembly 61 had been inserted into the connector. In addition, the preload feature could be eliminated.

Referring to FIGS. 5 and 6, a mating connector or device 106 is mated to the electrical connector. The connector or device 106 includes contacts 108 which engage the corresponding contacts 34. The contacts 34 include a first cantilever portion 110 and a second cantilever portion 112. Prior to insertion of the mating contact 108 the first and second cantilever portions 110, 112 are angled upward. Upon insertion of the mating contact 108, the first and second cantilever portions are deflected downward as shown in FIG. 6. Due to the characteristics of the metal, the cantilever portions continue to exert an upward force upon mating contact 108 in order to assure continuous electrical connection. Furthermore, as the mating contact 108 is inserted into the contact 34, the first cantilever portion 110 performs a wiping action which removes debris and oxidation from the contact 34 and mating contact 108 to assure a good electrical connection.

Figure 7:
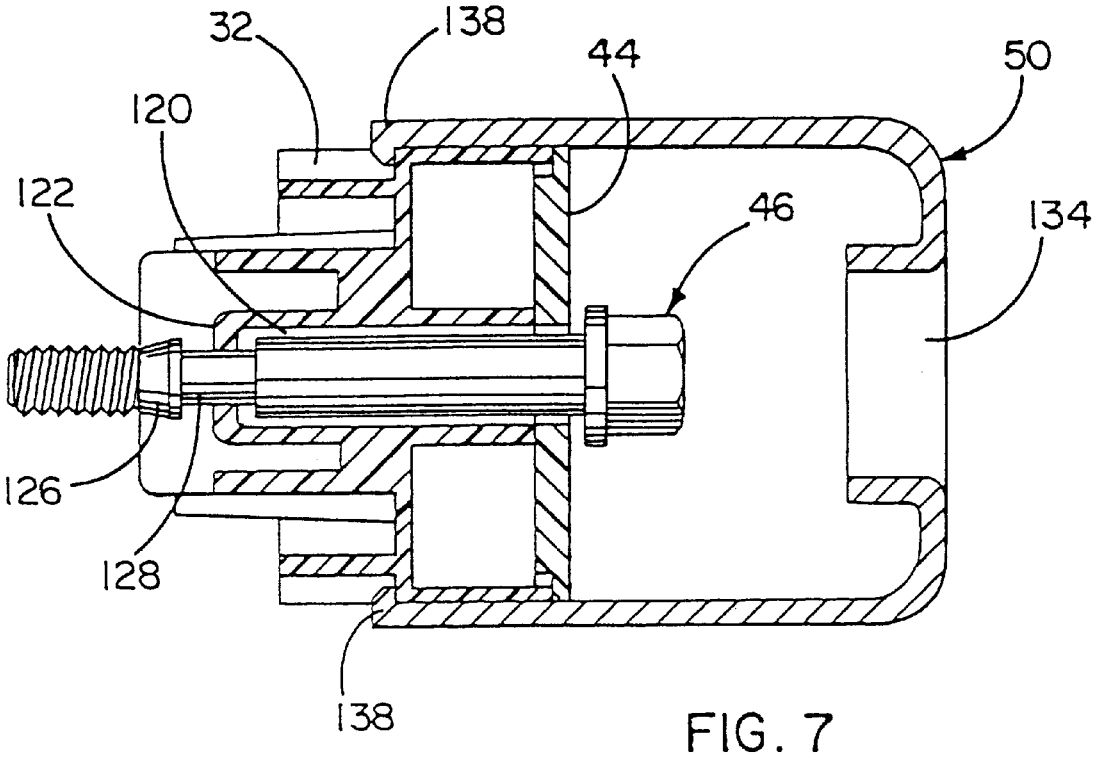
FIG. 7 is a cross sectional view of the electrical connector taken along line 7—7 of FIG. 3.

After the contact and wire assemblies 61 are inserted and the secondary locks 36, 38 have been inserted, the bolt 46 may be inserted into the electrical connector. Conversely, the bolt could be inserted prior to the insertion of the contact and wire assemblies 61. Referring to FIGS. 2 and 7, the housing 32 includes an aperture 120 to receive bolt 46. The aperture 120 includes a collar 122 which has a slot 124 to provide flexibility to the collar. The bolt 46 includes a ramp portion 126 and a reduced portion 128 which has a smaller cross-sectional area. Referring to FIG. 7, when the bolt 46 is inserted into the aperture 120 the ramp 126 will engage the collar 122. Due to the flexibility of the collar 122, the ramp 126 can be inserted through the collar 122. As the bolt 46 is inserted to the left in FIG. 7, the collar will engage the reduced portion 128. Preferably, the collar 122 will return to its relaxed state after encountering the reduced portion 128.

If desired, the collar 122 may be eliminated and a retaining ring 130 may be used which engages the reduced portion 128 of the bolt. After the bolt 46 is inserted into the aperture 120, the retaining ring 130 will be inserted over the threaded end of the bolt and the ramp 126 will engage the retaining ring 130. Due to the flexibility of the retaining ring, the ramp 126 can be inserted through the retaining ring 130 and the retaining ring will engage the reduced portion 128. Preferably, the retaining ring will return to its relaxed state after encountering the reduced portion 128. Furthermore, if additional retention is desired, the collar 122 may be used in conjunction with the retaining ring 130.

Referring to FIGS. 1 and 2, the housing 32 may also include ribs 132 which can be used for polarization. The number and spacing of the ribs 132 can be used to identify a connector with a specific wiring configuration. The mating connector or device 106 may include corresponding grooves to mate with the ribs 132. This polarization feature would assure that the proper connector is mated to the corresponding connector or device.

The threaded end of the bolt 46 will engage the mating connector or device 106 to assist in holding the electrical connector in position, especially when the electrical connector is subject to vibration. Depending upon the use of the connector, the bolt may not be required.

The electrical connector may also include a splash guard 50 which would assist in deflecting water from the rear of the electrical connector. The splash guard 50 may be used depending upon the particular use for the electrical connector. Referring to FIGS. 1, 2 and 7, the splash guard 50 includes an aperture 134, notches 136 and flanges 138. After the contact and wire assemblies 61 have been assembled to the connector, the splash guard 50 may then be assembled to the connector. The wires 60 are routed to the sides of the splash guard. As the splash guard is attached to the connector, the notches 136 engage protrusions 140 on the housing as shown in FIGS. 1 and 2. In addition, the flanges 138 engage the housing 32 as shown in FIGS. 1, 2 and 7. The aperture 134 provides access to the head of the bolt 46 after the splash guard 50 has been assembled to the connector.

Figure 14:
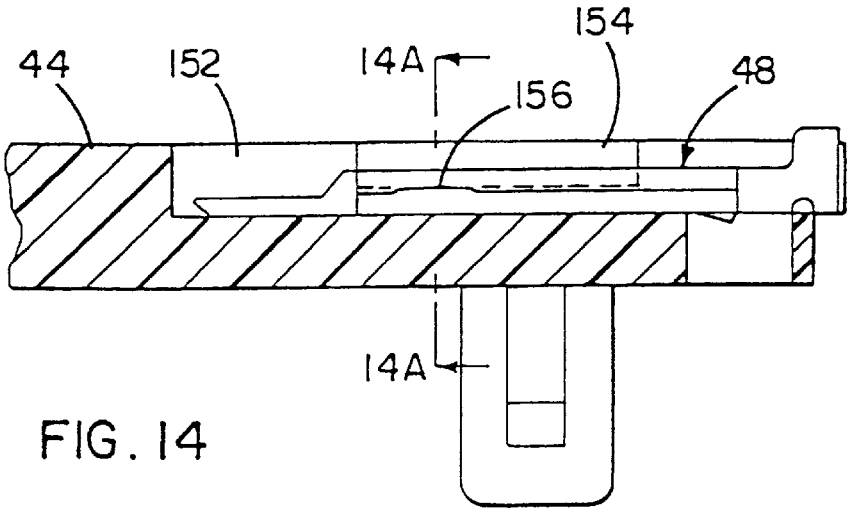
FIG. 14 is a fragmentary cross sectional view of the removal tool in the storage position taken along line 14—14 of FIG. 12.
Figure 14A:
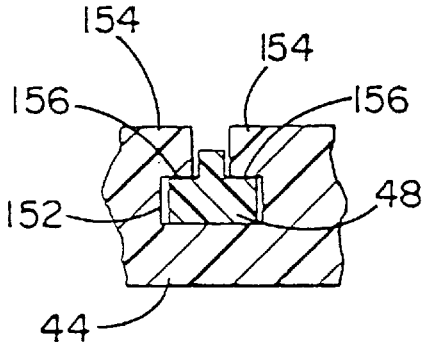
FIG. 14A is a fragmentary cross-sectional view taken along line 14A—14A of FIG. 14.

The electrical connector may also include a removal tool 48 which may be used to remove contacts from the electrical connector. As shown in FIGS. 2, 12 and 14, the removal tool 48 can be stored in the backplate 44. However, in other embodiments, the removal tool could be stored in other locations, such as, the housing 32. Referring to FIGS. 12, 14 and 14A, the removal tool 48 is stored in slot 152 in the backplate. The slot includes ledges 154 which frictionally engage the protuberances 156 on the removal tool. This frictional engagement assists in maintaining the removal tool in the storage position.

Figure 15:
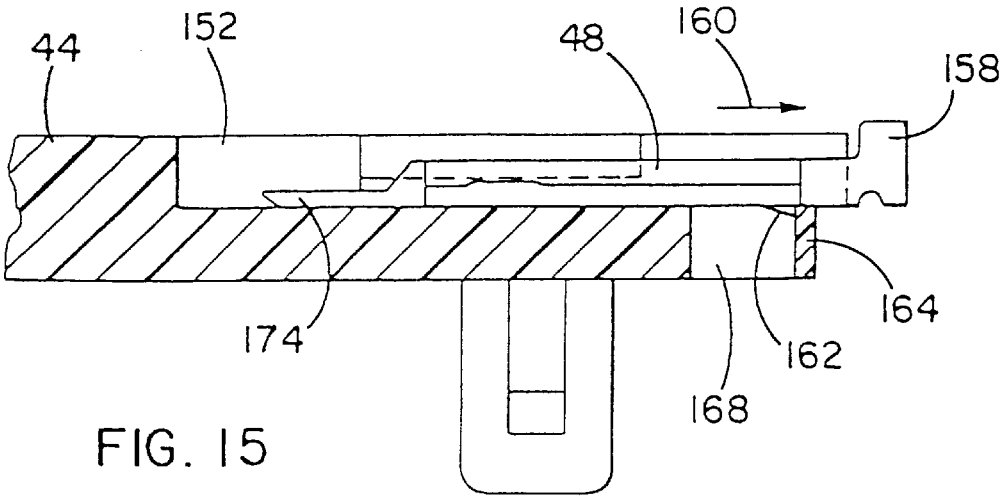
FIG. 15 is a fragmentary cross sectional view of the removal tool during the extraction from the storage position.
Figure 16:
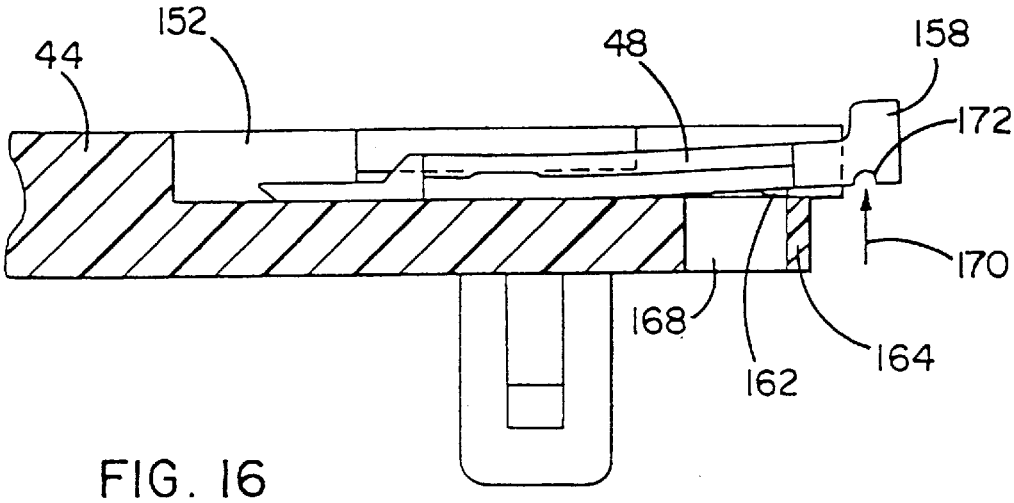
FIG. 16 is a fragmentary cross sectional view of the removal tool during the extraction from the storage position.
Figure 17:
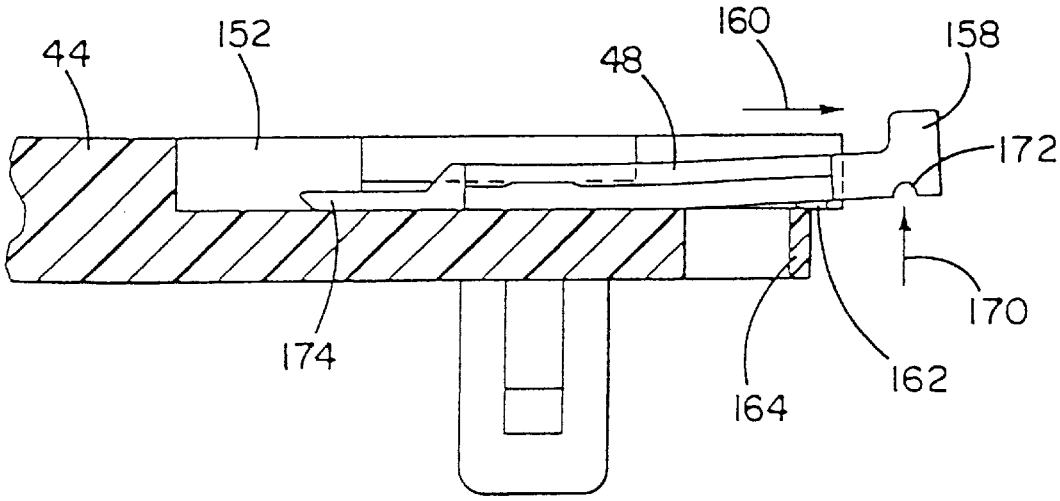
FIG. 17 is a fragmentary cross sectional view of the removal tool during the extraction from the storage position.

FIGS. 15–17 show the process for removing the removal tool from the storage position. Referring to FIG. 15, the user would use his or her finger to push on the handle portion 158 of the removal tool in the direction of arrow 160. A ramp 162 would engage the wall 164 of opening 168. The ramp 162 and wall 164 assist in maintaining the tool 48 in the slot 152. This retention feature supplements the frictional engagement between the ledges 154 and the protuberances 156 in case the frictional engagement is not sufficient.

Referring to FIG. 16, the user would use his or her finger to push the handle portion 158 in the direction of arrow 170. The handle portion includes a groove 172 which will accommodate the fingernail of the user and facilitate the removal process. As the user moves the handle 58 upward, the tool 48 will deflect and raise the ramp 162 above the wall 164.

Referring to FIG. 17, the user would use his or her finger to apply both an outward force in the direction of arrow 160 and an upward force in the direction of arrow 170 to move the ramp 162 past the wall 164. After the ramp has cleared the wall, the user may remove the tool 48 from the slot 152 in the direction of arrow 160.

In order to store the tool 48, the user would properly orient the tool 48 to the slot 152 and insert the lifting end 174 of the tool 48 into the slot. The tool 48 should be inserted so that the ramp 162 is within the opening 168 and the ramp 162 may hold the tool in the storage position.

Figure 18:
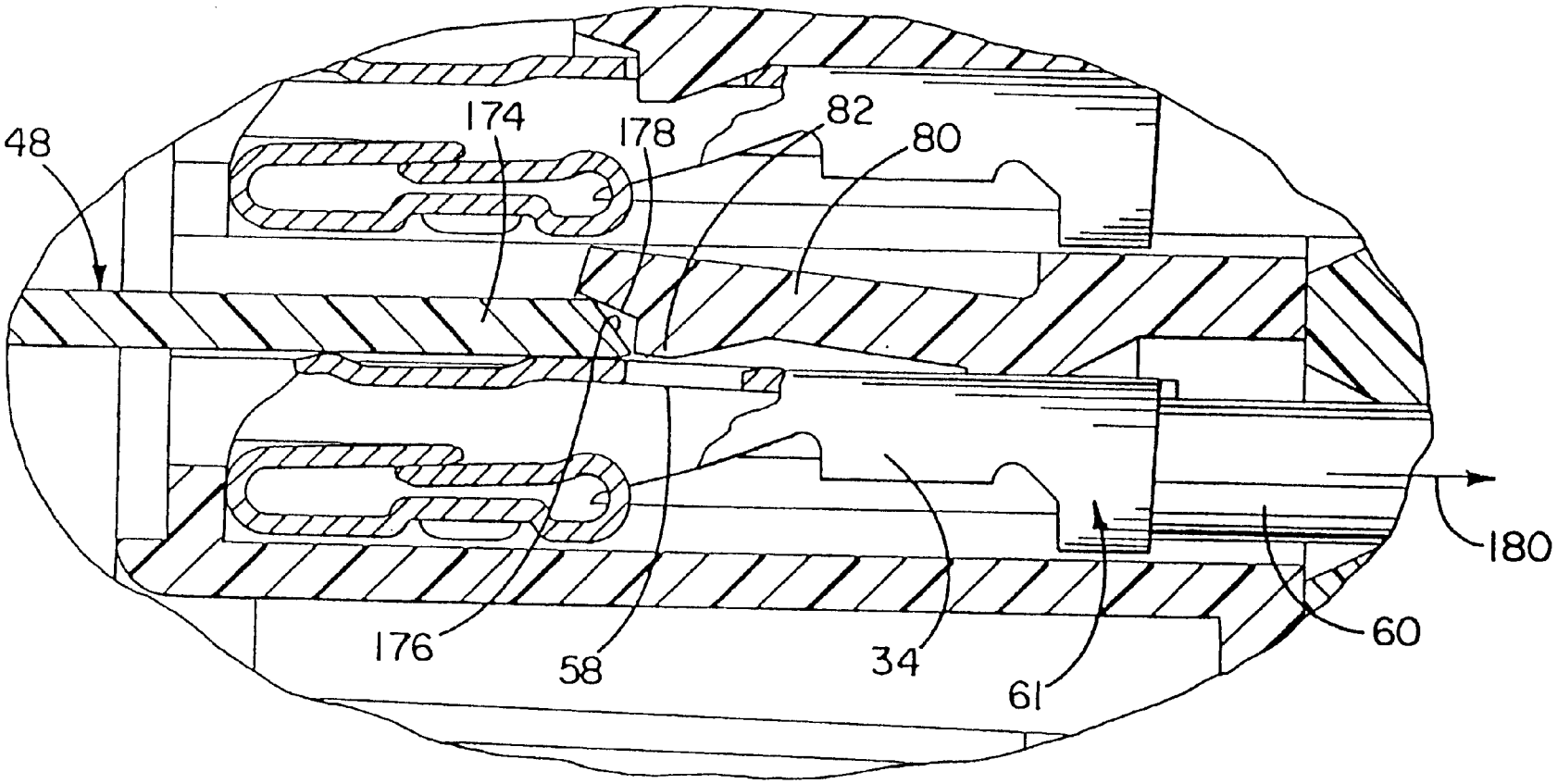
FIG. 18 is an enlarged cross sectional view similar to FIG. 6 showing the removal tool inserted into the electrical connector to lift the locking tab and release the contact for removal of the contact.

Referring to FIG. 18, the removal tool is used to assist in the removal of a contact and wire assembly 61. If a user wished to remove one of the contact and wire assemblies 61, then the user would need to remove the secondary lock 36, 38. The user may also wish to remove the splash guard 50 in order to gain access to the appropriate wire 60. The user would then locate the desired contact and wire assembly 61 using the indicia 86, 88. The user would insert the lifting end 174 of the removal tool into the housing 32 and engage locking tab 80. The ramp 176 on the tool would engage the mating ramp 178 on the locking tab. This engagement would cause the locking tab 80 to deflect upward and cause ramp 82 to be free of opening 58. After the contact 34 has been released, the user may pull or push the contact and wire assembly 61 in the direction of arrow 180.

As can be appreciated, the electrical connector can be arranged in several different configurations using the components. For example, the electrical connector may only include the housing 32 and the contact 34. In another embodiment, the electrical connector may include the housing 32, the contact 34 and the secondary lock 36. In an additional embodiment, the electrical connector may include the housing 32, the contact 34 and the grommet 40. In a further embodiment, the electrical connector may include the housing 32, the contact 34, the grommet 40, and the secondary lock 36. In yet another embodiment, the electrical connector may include the housing 32, the contact 34, the grommet 40, the secondary lock 36 and the backplate 44. In addition, all of the embodiments noted above may include one or more of the following: a retaining means, such as, bolt 46; a contact removal tool 48; or a splash guard 50.

Furthermore, the electrical connector can be arranged to have several different contact configurations. For example, the electrical connector may have 30 contact positions as noted above. However, other configurations involving a different number of rows and columns may be used. For example, the electrical connector may have 18 contact positions which involves two sets of three rows and three columns. As another example, the electrical connector may have 60 contact positions which involves three rows and 20 columns.

While particular embodiments of the invention have been shown, it will be understood, of course, that the invention is not limited thereto. On the contrary, we intend to cover all alternatives, modifications and equivalents as may be included within the scope and spirit of the invention as defined in the appended claims.

What is claimed is:

1. An electrical connector for connection to a device or second connector comprising:

a housing having a contact passageway for housing a contact therein for engaging a mating contact of a device or second connector, a locking mechanism for locking said contact in said contact passageway, a tool holder, and a contact removal tool, said tool being mountable to said tool holder in a stored position even when connected to said device or second connector and being insertable in said contact passageway and engageable with said locking mechanism for releasing said locking mechanism.

2. The connector according to claim 1 further including a backplate, said tool holder being arranged on said backplate.

3. The connector according to claim 2 wherein said tool holder comprises a slot in said backplate and said tool is mountable in said slot in said stored position.

4. The connector according to claim 3 wherein said tool frictionally engages said slot in said stored position.

5. The connector according to claim 3 wherein a retention mechanism maintains said tool in said stored position in said slot.

6. The connector according to claim 5 wherein said retention mechanism includes a ramp portion on said removal tool which is engageable with a complementary wall portion in said slot.

7. The connector according to claim 1 wherein the tool holder is arranged on said housing.

8. A method for removing a contact from a contact passageway in an electrical connector comprising:

providing an electrical connector which includes a contact and a contact removal tool, removing said contact removal tool from a tool holder arranged on said connector, and inserting said contact removal tool into said contact passageway to remove said contact.

9. The method according to claim 8 wherein the step of removing said contact removal tool includes disengaging a retention mechanism to remove said contact removal tool.

10. The method according to claim 8 wherein the step of removing said contact removal tool includes frictional engagement between the contact removal tool and the connector.

11. The method according to claim 8 wherein the tool holder comprises a slot, the step of removing said contact removal tool includes removing the contact removal tool from the slot.

12. The method according to claim 8 wherein the connector includes a backplate, the step of removing said contact removal tool includes removing the contact removal tool from the tool holder arranged on the backplate.

13. The method according to claim 8, wherein the connector includes a housing, the step of removing said contact removal tool includes removing the contact removal tool from the tool holder arranged on the housing.

14. The method according to claim 8 wherein step of removing said contact removal tool includes engaging a groove on said contact removal tool and pulling said contact removal tool from said tool holder.

15. The method according to claim 8 wherein the contact is retained in the contact passageway by a locking tab which is movable between an engaged position wherein the locking tab prevents movement of the contact relative to the contact passageway and a retracted position wherein the locking tab permits movement of the contact relative to the contact passageway, further including the steps of:

engaging said locking tab with said contact removal tool, moving said locking tab to said retracted position with said contact removal tool, and moving said contact out of said contact passageway while said locking tab is in said retracted position.

16. The method according to claim 8 further including the step of removing a secondary lock from a front surface of said housing prior to inserting said removal tool in said contact passageway.

17. The method according to claim 8 wherein said removal tool is inserted in a front end of the contact passageway and said contact is moved out of the contact passageway through a rear end of the contact passageway.

18. The method according to claim 15 wherein said locking tab is moved to said retracted position by deflecting the locking tab through engagement of a ramp on said contact removal tool with a complementary ramp on said locking tab.

19. The method according to claim 8 further including the step of replacing said contact removal tool into a stored position in said tool holder on said connector after said contact has been removed from said contact passageway.

20. The method according to claim 19 wherein the step of replacing said contact removal tool includes engaging a retention mechanism as said contact removal tool is positioned into said tool holder to hold said contact removal tool.

21. The method according to claim 19 wherein the step of replacing said contact removal tool includes frictional engagement between the contact removal tool and the tool holder.

22. The method according to claim 19 wherein the tool holder comprises a slot, the step of replacing said contact removal tool includes positioning the contact removal tool in the slot.

23. The method according to claim 19 wherein the connector includes a backplate, the step of replacing said contact removal tool includes positioning the contact removal tool in the tool holder in the backplate.

24. The method according to claim 19, wherein the connector includes a housing, the step of replacing said contact removal tool includes positioning the contact removal tool in the tool holder in the housing.

25. The connector according to claim 1 wherein said contact removal tool is mountable to said tool holder in said stored position during connection to a device or second connector.

26. The method according to 19 wherein said contact removal tool is held in said stored position in said tool holder during connection to a device or second connector.

* * * * *